United States Patent [19]

Lingle

[11] Patent Number: 4,858,403

[45] Date of Patent: Aug. 22, 1989

[54] FASTENING BAR ASSEMBLY FOR FRAMELESS INSULATING PANELS

[76] Inventor: Cleo M. Lingle, #3 Palisades, Longview, Tex. 75601

[21] Appl. No.: 200,708

[22] Filed: Jun. 1, 1988

[51] Int. Cl.[4] ..... E04B 2/82

[52] U.S. Cl. ..... 52/127.12; 52/127.9; 52/309.9; 52/309.11; 52/802; 52/583

[58] Field of Search ..... 52/309.9, 309.11, 583, 52/584, 587, 802, 127.9, 127.12

[56] References Cited

U.S. PATENT DOCUMENTS

| | | | |
|---|---|---|---|
| 2,741,341 | 4/1956 | Anderson | 52/127.9 X |
| 3,496,692 | 2/1970 | Melcher | 52/583 |
| 4,044,511 | 8/1977 | Lingle | 52/583 X |
| 4,070,848 | 1/1978 | Lingle | 52/583 X |

*Primary Examiner*—David A. Scherbel
*Assistant Examiner*—Jerrold D. Johnson
*Attorney, Agent, or Firm*—Kimmel, Crowell & Weaver

[57] ABSTRACT

A fastening bar assembly for connecting together adjacent insulating panels of an insulated enclosure, in which the panels have a foamed in situ insulating foam core and metal skins on the inner and outer faces thereof, and wherein the fastening bar assembly is encapsulated in the foam core and has connecting means on opposite ends thereof for securing together adjacent ends of fastening bar assemblies in adjacent panels. In the present invention, an improved fastening bar assembly comprises an elongate bar body having opposite ends bent at an angle to the body and extending into proximity with a peripheral flange on the skin of the panel and secured to the flange on the skin, whereby in a completed panel the fastening bar serves to strengthen the skin and prevent its delamination from the foam core, and said fastening bar is also accurately positioned in the panel. In addition, an improved panel sealing gasket is secured to a side edge of the panel.

8 Claims, 3 Drawing Sheets

FASTENING BAR ASSEMBLY FOR FRAMELESS INSULATING PANELS

FIELD OF THE INVENTION

This invention relates to insulating panels, and more particularly, to a fastening bar assembly for such panels.

PRIOR ART

Foamed-in-place insulating panels covered with metal skins and used for constructing walk-in refrigerators, refrigerated warehouses and the like are known in the art, as exemplified, for example, in applicant's prior U.S. Pat. Nos. 4,044,511 and 4,070,848. As described in these patents, the insulating panels are secured together at adjacent side edges by use of threaded fasteners and locking or fastening bar assemblies embedded in the foamed plastic panels. The fastening bar assemblies in these patents include anchors which extend into the foam core of the panel, and at least in some instances the anchors extend to the skin of the panel for assisting in the proper positioning of the fastening bar relative to the skin. U.S. Pat. No. 4,070,848 also introduced nylon threaded couplings or pods for use in securing adjacent panels together.

Moreover, during assembly of prior art panels, including those of applicant's prior U.S. Pat. Nos. 4,044,511 and 4,070,848, sealing gaskets are positioned between confronting edges of adjacent panels to seal the panels relative to one another. These sealing gaskets are typically held in position by the person constructing the refrigerated warehouse or the like, until the panels are fastened together to hold the gaskets in place.

SUMMARY OF THE INVENTION

Accordingly, it is an object of the present invention to provide a simplified fastening bar assembly for insulated panels used in constructing walk-in refrigerators, refrigerated warehouses and the like.

Another object of the invention is to provide an improved fastening bar assembly for insulated panels, wherein the anchors normally provided along the length of the bar are eliminated.

A further object of the invention is to provide a fastening bar assembly for insulated panels, in which the ends of the bar are connected to the outer skin of the panel to reinforce the skin and assist in positioning the bar relative to the skin.

Yet another object of the invention is to provide an improved connecting or coupling pod for attaching panels together, in which an integrally molded foot on the pod is used to secure the pod to the fastening bar.

A further object is to provide an improved panel sealing gasket for insulated panels used in the construction of walk-in refrigerators, refrigerated warehouses and the like.

These objects of the invention are accomplished by the improved and simplified fastening bar assembly of the invention, wherein an elongate, channel-shaped bar extends across the width of the panel and is secured at its opposite ends to jig fixtures which, together with inner and outer metal skins, form an enclosure in which an insulating core is foamed in situ. The opposite ends of the bar include portions bent at a right angle and extending into engagement with the marginal edge of the outer metal skin. Fasteners secure these ends to the skin, thereby reinforcing the metal skin and assisting in preventing delamination of the skin from the foam core.

Additionally, the connection of the ends of the bar to the outer metal skin positions the bar relative to the skin, insuring proper alignment of the fastening components during assembly of the panels to form a walk-in refrigerator or the like.

Further, improved panel gaskets are secured to one of the side edges of the panels during manufacture of the panels, thus facilitating assembly of the panels to one another to form a walk-in refrigerator or the like. And, female threaded nylon pods or connecting elements are attached to one end of the bar by screws extended through the bar and into an integrally formed flange on the pod.

BRIEF DESCRIPTION OF THE DRAWINGS

The foregoing and other objects and advantages of the invention will become apparent from the following detailed description when taken in conjunction with the accompanying drawings, in which like reference characters designate like parts throughout the several views, and wherein.

DETAILED DESCRIPTION OF THE PREFERRED EMBODIMENTS

Figures 1, 2:
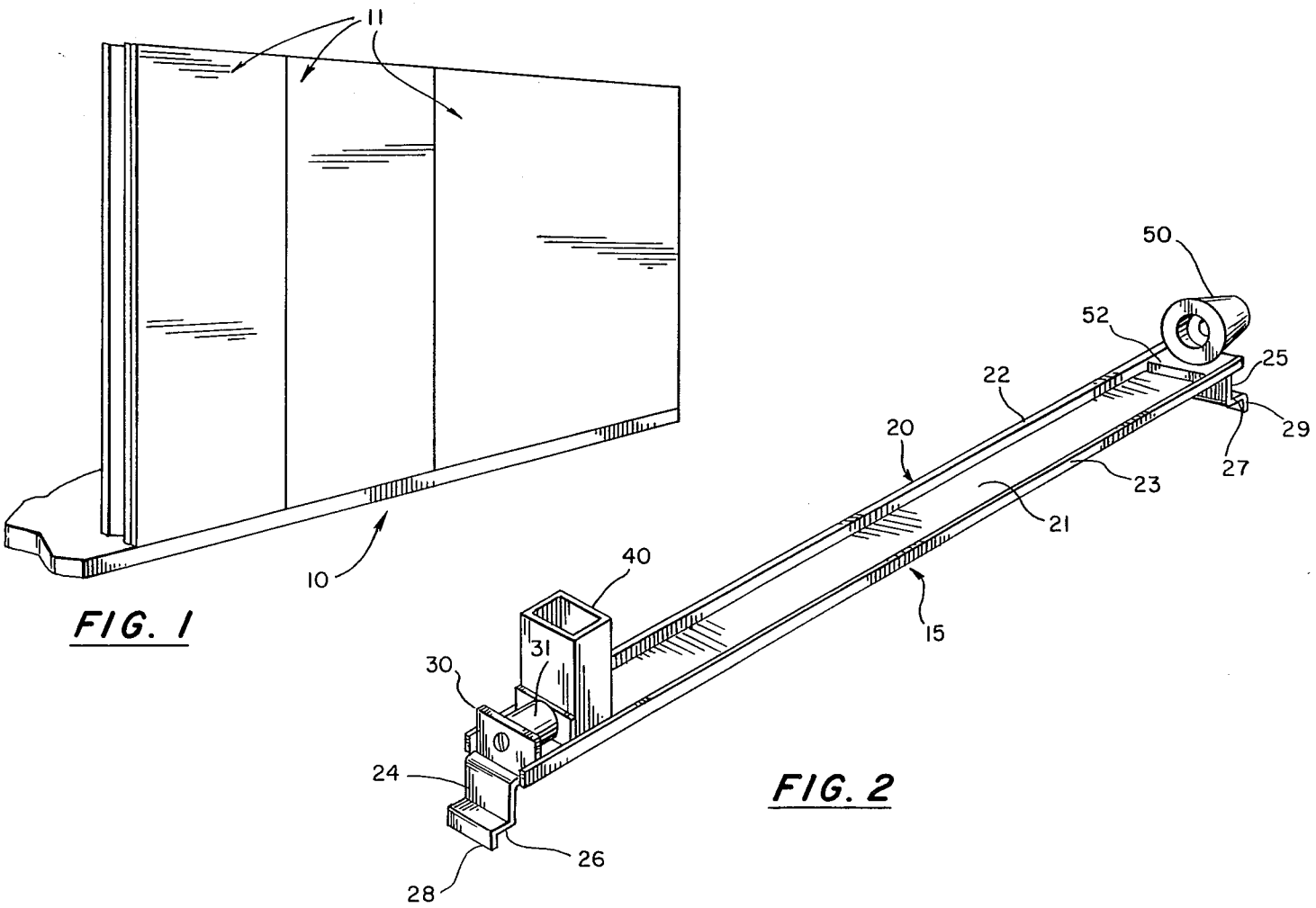
FIG. 1 is a fragmentary, perspective, somewhat schematic view of a portion of a refrigerated enclosure made in accordance with the invention.
FIG. 2 is a perspective view of the fastening bar assembly of the invention, shown prior to attachment to the jig fixtures or skins of the panel.

Referring more particularly to the drawings, an insulated enclosure 10, such as a refrigerated warehouse, walk-in freezer, or the like is constructed from edge-to-edge connected foam-filled metal skin covered rectangular insulating panels 11. The insulating panels are frameless, and the insulating core is foamed in situ in each panel in accordance with the teachings in the aforesaid patents. In this regard, and with reference to FIG. 3, end jig fixtures 12 and 13 are secured at opposite ends of a panel fastening ar assembly 15, and, in conjunction with inner and outer metal skins 16 and 17 form a hollow enclosure into which a liquid urethane is introduced and foamed in situ to form the insulating foam core 18 of each panel. Following the curing of the foam cores, the jig fixtures are removed. The fastening bar assemblies are encapsulated entirely within the foam cores of the panels, with the metal skins permanently attached on opposite faces thereof.

The improved fastening bar assembly 15 in accordance with the present invention comprises an elongate, channel-shaped body 20 having a web portion 21 with upturned flanges 22 and 23 along opposite edges, as in the aforesaid earlier patents. However, in the present invention the web portion 21 is made longer than the flanged, channel-shaped body, and the ends 24 and 25 are bent downwardly at a right angle, each terminating in a short, horizontally extending portion or ledge 26 and 27, respectively, and a downturned foot 28 and 29, respectively. The fastening bar is preferably made from galvanized metal, and is of a length to extend for the major part of the width of the insulating panel, whereby the coupling or attachment of adjacent panels is through the adjoining ends of the fastening bars in the panels.

As further described in the aforesaid patents, a transversely extending U-shaped clip 30 is fixed at one end of the channel-shaped body between the shallow side flanges 22 and 23 as by spot welding or the like, and a spacer 31 is secured between the legs of the U-shaped clip.

A box-like enclosure 40 is also secured at said end of the fastening bar, and with clip 30 serves to hold a threaded fastener 41 as more fully described in the aforesaid patents.

At the opposite end of the channel-shaped body, a female threaded coupling element 50 is secured to the web 21 by suitable fasteners, such as sheet metal screws or the like 51 extended through the web and into a generally rectangularly shaped flange or foot 52 integrally formed on the coupling element. The coupling element is preferably formed from a synthetic material such as nylon or the like, and is used to attach adjacent panels together in edge-to-edge abutment as described in the earlier patents. However, rather than the square flange and mounting bracket for attaching the coupling element to the channel-shaped body as described in said earlier patent, the integral flange 52 is simply secured to the web of the bar by use of screws 51. The ends of the flange 52 are engaged between the flanges 22 and 23 at the sides of the web and assist in holding the coupling element in proper position.

Figure 3:
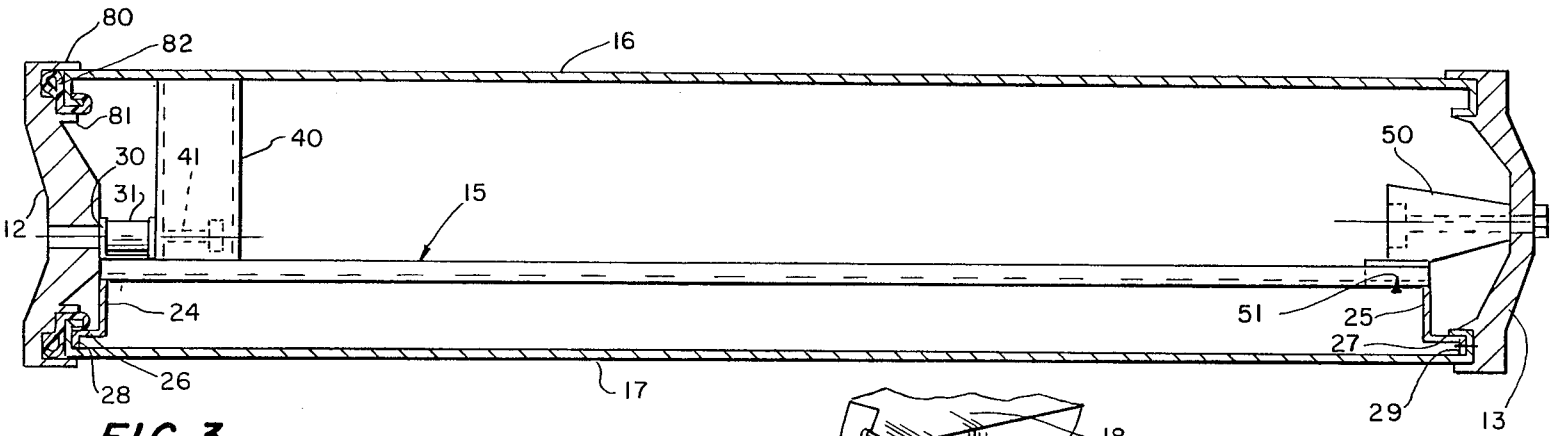
FIG. 3 is an enlarged longitudinal sectional view of the fastening bar, with jig fixtures and metal skins of the panel attached.
Figure 5:
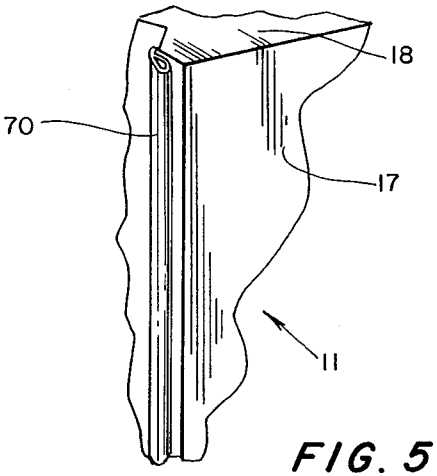
FIG. 5 is a somewhat schematic, fragmentary perspective view of an edge portion of the panel, showing the panel sealing gasket.
Figure 4:
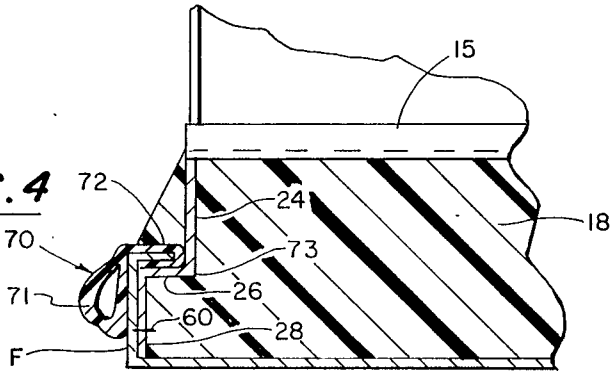
FIG. 4 is a greatly enlarged, fragmentary sectional view of one end of a finished panel made in accordance with the invention, showing the panel sealing gasket secured in place on the side edge of the panel.
Figure 8:
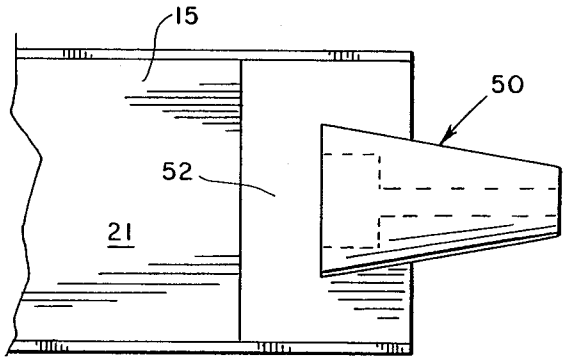
FIG. 8 is a top plan view of the assembly of FIG. 6.
Figure 7:
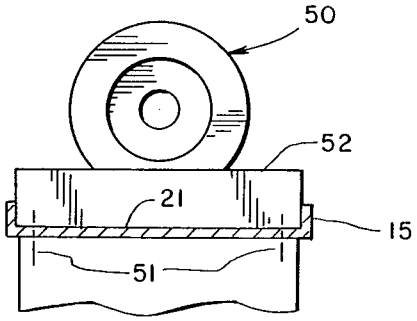
FIG. 7 is a view in section taken along line 7—7 in FIG. 6.
Figure 6:
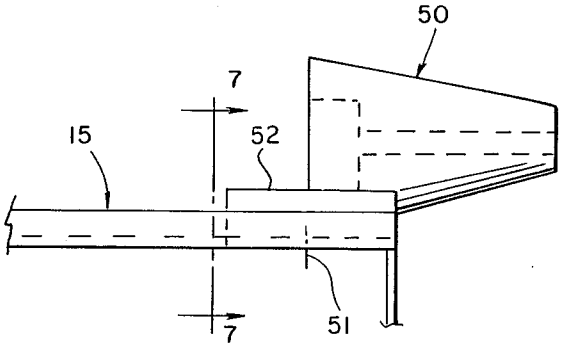
FIG. 6 is an enlarged, fragmentary view in side elevation of the fastening bar and threaded nylon pod assembly.

As seen best in FIGS. 2 and 3, the ends 24 and 25 of the fastening bar assembly 15 extend into close proximity with the outer skin 17, and the horizontally extending ledges 26 and 27 and feet 28 and 29 nest or interengaged behind the channel-shaped flange "F" on the marginal edge of the skin 17. Pop rivets or other suitable fasteners 60 secure the feet 28 and 29 to the flange "F". This arrangement reinforces the outer skin 17, helping to prevent delamination of the skin from the foam core, and also serves to position the fastening bar assembly relative to the skins and jig fixtures, thereby facilitating subsequent assembly of the panels together in edge-to-edge relationship with one another.

An improved panel sealing gasket 70 is secured to the outer surfaces of the flanges "F" at one side edge of the panel. The gasket comprises an extruded member of suitable resilient material having a bulb portion 71 which lies against the outer face of the flange "F" and an integrally formed leg 72 which is shaped to wrap around the inturned portion 73 of the flange "F".

As seen best in FIGS. 2 and 3, the jig fixtures 12 and 13 have inwardly projecting flanges 80 and 81 along their opposite edges defining a channel 82 in which the sealing gasket 70 and flange "F" of the skins are received. These flanges 80 and 81 are narrower than the inturned portion 73 of the flange "F" on the skin, and thus narrower than the leg 72 on the gasket 70. Accordingly, when the foam core is formed in the panel, the leg 72 of the sealing gasket is embedded in the foam. This, together with the shape of the extruded leg 72 and its wrapped-around relationship to the flange on the skin and the foot on the end of fastening bar assembly, securely positions the sealing gasket during assembly of the panels. Moreover, the bulb 71 is adhesively secured to the outer face of the flange "F". Thus, it is not necessary to hold the sealing gasket in place while two panels are assembled in edge-to-edge relationship, as necessary in the prior art.

Assembly of the panels together in edge-to-edge relationship using the threaded fasteners and coupling elements is otherwise the same as described in said earlier patents.

The simplified panel fastening bar assembly and panel sealing arrangement of the invention results in a more economical panel construction, and one which is easier to assemble and is stronger and more durable.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

I claim:

1. In a fastening bar assembly for connecting together adjacent insulated panels of an insulated enclosure, in which the panels have an insulating foam core and a skin on at least an outer face thereof, said skin having a peripheral flange, and wherein the fastening bar assembly is adapted to be encapsulated in the foam core and has connecting means on opposite ends thereof for securing together adjacent ends of fastening bar assemblies in adjacent panels, the improvement comprising:

an elongate bar body having opposite ends and adapted for encapsulation in the foam core of an insulated panel, said opposite ends bent at an angle to the body for extending within the foam core and into proximity with a peripheral flange on the skin of a panel and to be secured to the flange on the skin, whereby in a completed panel the fastening bar serves to strengthen the skin and prevent its delamination from the foam core, and said fastening bar is also accurately positioned in the panel.

2. In a fastening bar assembly as claimed in claim 1, wherein:

said bar body has a shallow channel-shape in transverse cross section, having a web portion with upstanding flanges along opposite side edges thereof, and the connecting means at one end of the bar body comprises a molded body having an internally threaded bore therethrough and an integrally formed rectangularly shaped foot flange thereon engaged between the flanges on the bars body to position the connecting means on the bar body, and fastening means extending through the web of the bar body and into the foot flange to secure the connecting means to the bar body.

3. In a structural, insulated, frameless panel for constructing walk-in refrigerators, refrigerated warehouses and the like, wherein the panel has inner and outer faces with inner and outer metal skins thereon, respectively, said skins having peripheral portions, a foam core, opposite side edges, and a fastening bar assembly embedded within the foam core and extending across the width of the panel between opposite side edges thereof to fasten adjacent panels together, the improvement comprising:

opposite end portions of the fastening bar assembly bent at an angle to the bar and extending within the foam core into proximity with a peripheral portion of the outer skin of the panel; and fastening means extended through the end portions of the bar assembly and the peripheral portion of the skin to secure the bar assembly and skin in position relative to one another, thereby reinforcing the skin and impeding its delamination from the foam core while at the same time accurately positioning the bar assembly in the panel.

4. In a panel as claimed in claim 3, wherein:

connecting means are on the ends of the fastening bar assembly for connecting adjacent ends of adjacent bars, said connecting means being spaced inwardly from the end portions which are bent at an angle to the bar.

5. In a panel as claimed in claim 3, wherein:

the skins on the panel have inturned, channel-shaped flanges on at least their peripheral side edges, defining an outer end edge face on the panel; and a panel sealing gasket is affixed to the outer end edge face of the panel, said gasket having a sealing portion overlying the face and an attaching portion wrapped around the flange on the skin, whereby the sealing gasket need not be held in position by the installer during assembly together in edge-to-edge relationship of a plurality of said panels.

6. In a panel as claimed in claim 5, wherein:

the sealing portion of the gasket comprises a bulb-shaped body; and said body is adhesively secured to the outer end edge face of the panel.

7. In a panel as claimed in claim 6, wherein:

the attaching portion of the gasket is integrally formed with the bulb-shaped body and is formed with a shape complemental to the shape of the flange.

8. In a panel as claimed in claim 3, wherein:

the skins on the panel have inturned, channel-shaped flanges on at least their peripheral side edges; and the opposite, bent end portions of the fastening bar include a first portion extending at a right angle to the bar, and second and third portions shaped to conform to the shape of the flange on the skin and being nested in said flange and secured thereto.

* * * * *